US005395111A

United States Patent [19]

Inoue

[11] Patent Number: 5,395,111

[45] Date of Patent: Mar. 7, 1995

[54] SLOT MACHINE WITH OVERLYING CONCENTRIC REELS

[75] Inventor: Haruo Inoue, Tokyo, Japan

[73] Assignee: Eagle Co., Ltd., Tokyo, Japan

[21] Appl. No.: 177,545

[22] Filed: Jan. 5, 1994

[51] Int. Cl.[6] ..... A63F 5/04

[52] U.S. Cl. ..... 273/143 R; 273/138 A

[58] Field of Search ..... 273/143 R, 143 A, 143 B, 273/143 C, 143 D, 143 E, 138 R, 138 A, 142 R, 142 HA, DIG. 28, 142 H, 85 CP; 364/410, 411, 412

[56] References Cited

U.S. PATENT DOCUMENTS

| | | | |
|---|---|---|---|
| 4,700,948 | 10/1987 | Okada | 273/143 R |
| 5,152,529 | 10/1992 | Okada | 273/143 R |
| 5,251,898 | 10/1993 | Dickenson | 273/143 R |

FOREIGN PATENT DOCUMENTS

| | | | |
|---|---|---|---|
| 2062326 | 5/1981 | United Kingdom . | |
| 2073929 | 10/1981 | United Kingdom | 273/143 R |
| 2105891 | 3/1983 | United Kingdom . | |
| 2165074 | 4/1986 | United Kingdom | 273/143 R |
| 2165387 | 4/1986 | United Kingdom | 273/143 R |
| 2193025 | 1/1988 | United Kingdom | 273/143 R |
| 2194093 | 2/1988 | United Kingdom | 273/143 R |
| 2233806 | 1/1991 | United Kingdom | 273/138 A |

*Primary Examiner*—Sebastiano Passaniti

*Attorney, Agent, or Firm*—Young & Thompson

[57] ABSTRACT

A slot machine has inner and outer coaxial overlying reels. Each reel is formed with symbols on its transparent outer circumferential frame. The inner and outer reels are rotated independently by motors. The outer reel has a transparent outer circumferential frame to allow a player to see symbols on the inner reels. A combined symbol of superposed inner and outer reel symbols is produced.

3 Claims, 7 Drawing Sheets

SLOT MACHINE WITH OVERLYING CONCENTRIC REELS

BACKGROUND OF THE INVENTION

1. Field of the Invention

The present invention relates to a reel-type slot machine, and more particularly to a slot machine which presents combined symbols visible on overlying concentric reels.

2. Description of the Related Art

Slot machines are grouped into two types, namely, a mechanical reel type in which reels are rotated, and a video type in which an electronic display is used to simulate the rotation of reels. In a slot machine of the video type, the rotation and stopping of mechanical reels are simulated by using graphical data and displayed on a display such as a CRT. Many players prefer the mechanical reel type because they suspect that the results of play have been intentionally controlled with the video type.

In a slot machine of the mechanical reel type, three reels for example are rotated at the same time, mechanically upon actuation of a start lever, or electrically with the help of motors, upon actuation of the start lever. The three reels are thereafter stopped sequentially by operating a stop button provided for each reel or by a stop signal randomly generated by a random timer. A win or hit is determined by a combination of symbols on the three stopped reels along a winning line viewed from the observation windows. If the symbol combination is a winning symbol combination, dividend coins are paid out or a special favor such as a bonus game is given to the player.

A drawback of conventional mechanical reel type slot machines is that the game is simple and monotonous because the conventional machines have all adopted the same method whereby a winning symbol combination is determined by a sequence of starting and stopping a single set of reels appearing in the observation windows. Moreover, the number of symbols on the outer circumference of each reel is limited by the outer diameter of the reel, it being impossible to increase the number of symbols above a certain limit. Therefore, the number of symbol combinations is limited, which reduces the interest in playing the game.

SUMMARY OF THE INVENTION

It is an object of the present invention to provide a slot machine capable of providing complicated and thrilling games.

It is another object of the present invention to provide a slot machine capable of displaying a larger number of symbols without using reels of a large size.

The above and other objects of the present invention can be achieved by providing, in a slot machine, an outer reel having at least one transparent part on the outer circumferential frame of the outer reel, and an inner reel mounted within coaxially with the outer reel and being capable of rotating independently from the outer reel. Symbols formed on the outer circumference of the outer reel can be viewed through transparent parts. As a result, symbols on the inner and outer reels are combined, it being possible to view the combined symbols through an observation window. The combined symbol is a new symbol, different from two original symbols, composed of an inner reel symbol visible through a transparent area on the outer reel, plus an outer symbol on the outer reel.

According to the present invention, a greatly increased number of symbols can be formed without using a reel having a large diameter. By independently rotating the inner and outer reels, the combined display of the two reels provides a novel game sense and eliminates the monotony of a conventional slot machine. By stopping the reels at different times, interest in the game is increased.

BRIEF DESCRIPTION OF THE DRAWINGS

The above and other objects and advantages of the present invention will become apparent from the detailed description of the preferred embodiments when read in conjunction with the accompanying drawings, in which.

DETAILED DESCRIPTION OF THE PREFERRED EMBODIMENTS

Figure 1:
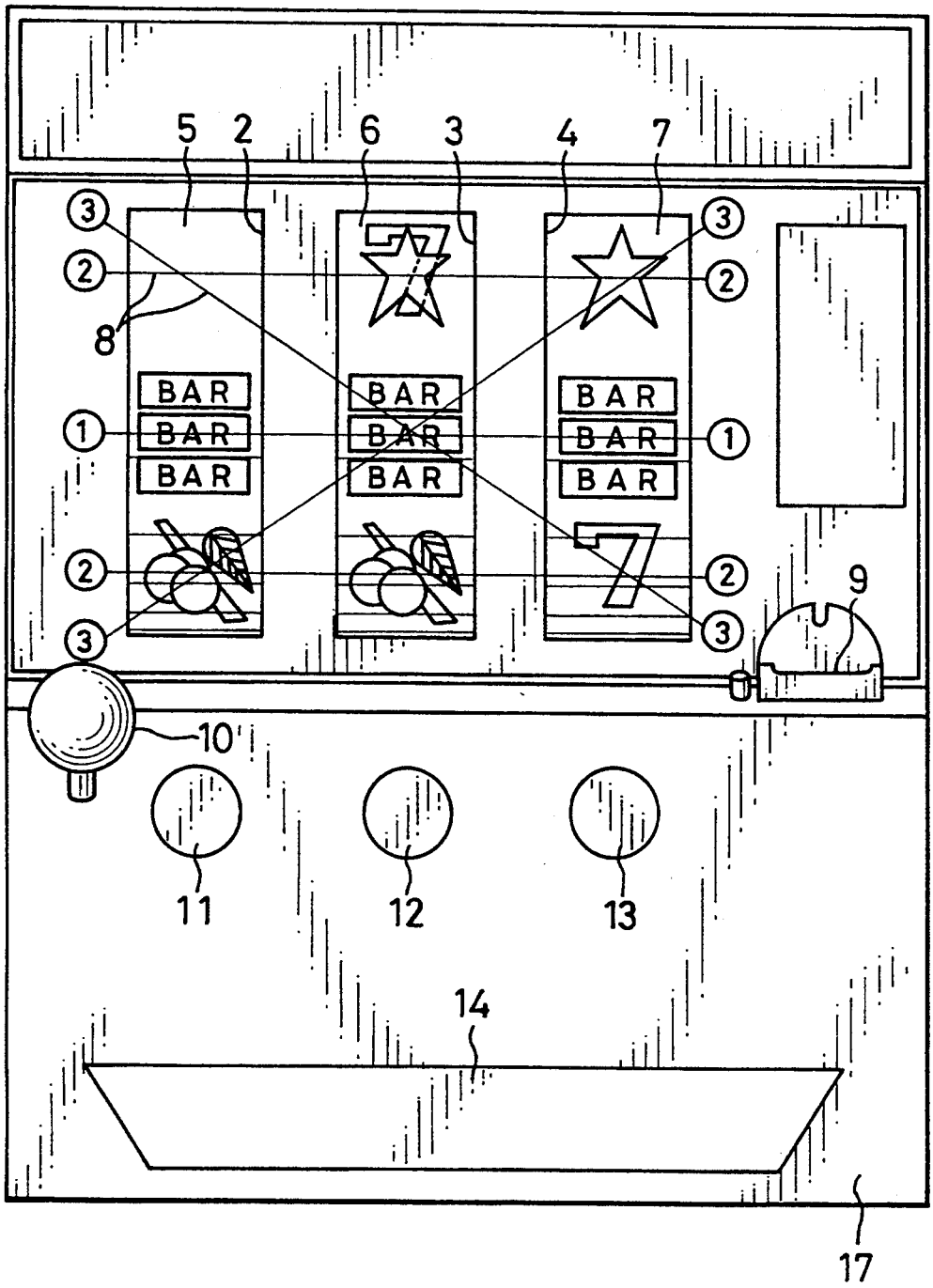
FIG. 1 is a front view of a slot machine according to an embodiment of the present invention.

Referring to FIG. 1 showing the slot machine of the invention, three observation windows 2, 3 and 4 are formed at the central area of the housing 17 of the slot machine, and first to third reels 5, 6 and 7 are rotatably mounted behind the observation windows 2, 3 and 4. Symbols (including blank regions) are spaced about the outer periphery of the first to third reels 5 to 7 at a preferred pitch. When all the reels 5 to 7 stop, three symbols per reel, or a total of nine symbols, can be viewed via the observation windows 2 to 4. Winning lines 8 are used for identifying combinations of symbols for each game when the reels 5 to 7 stop. The number of winning lines to be made effective is determined by the number of coins inserted into a coin inlet 9 prior to starting each game.

When a start lever 10 is operated after inserting a coin or coins, the first to third reels 5 to 7 start rotating at the same time, and after a predetermined time lapse, a stop operation is permitted. The stop operation is effected independently for each reel by using stop buttons 11, 12 and 13. If a combination of three symbols on an effective winning line 8 appearing when the reels 5 to 7 stop is a winning symbol combination, as many coins as have been predetermined for the winning symbol combination are paid out onto a saucer 14.

Figure 2:
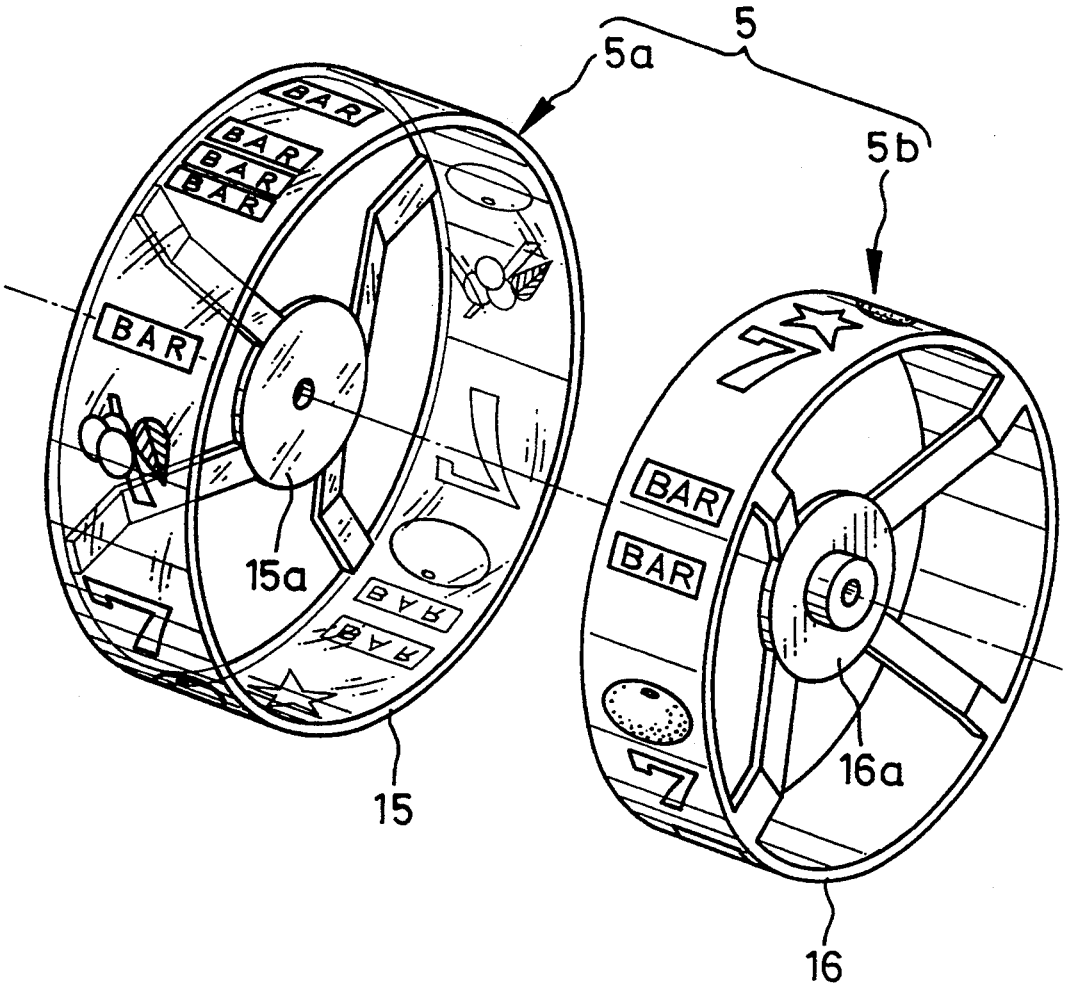
FIG. 2 is an exploded perspective view showing the structure of the reels.

Each of the first to third reels 5 to 7 has an outer reel and an inner reel. FIG. 2 shows the structure of the first reel 5. An outer reel **5*a* has a transparent plastic outer circumferential frame 15 on which a plurality of symbols are formed including "1BAR", "3BAR", "star", "7 ", "cherry", and the like. An inner reel 5*b* has an opaque outer circumferential frame 16** like a conventional reel on which a plurality of symbols are formed.

Mounting plates **15*a* and 16*a* are integrally formed with the outer circumferential frames 15 and 16**, the plates being coupled to the shafts of stepping motors.

Figure 3:
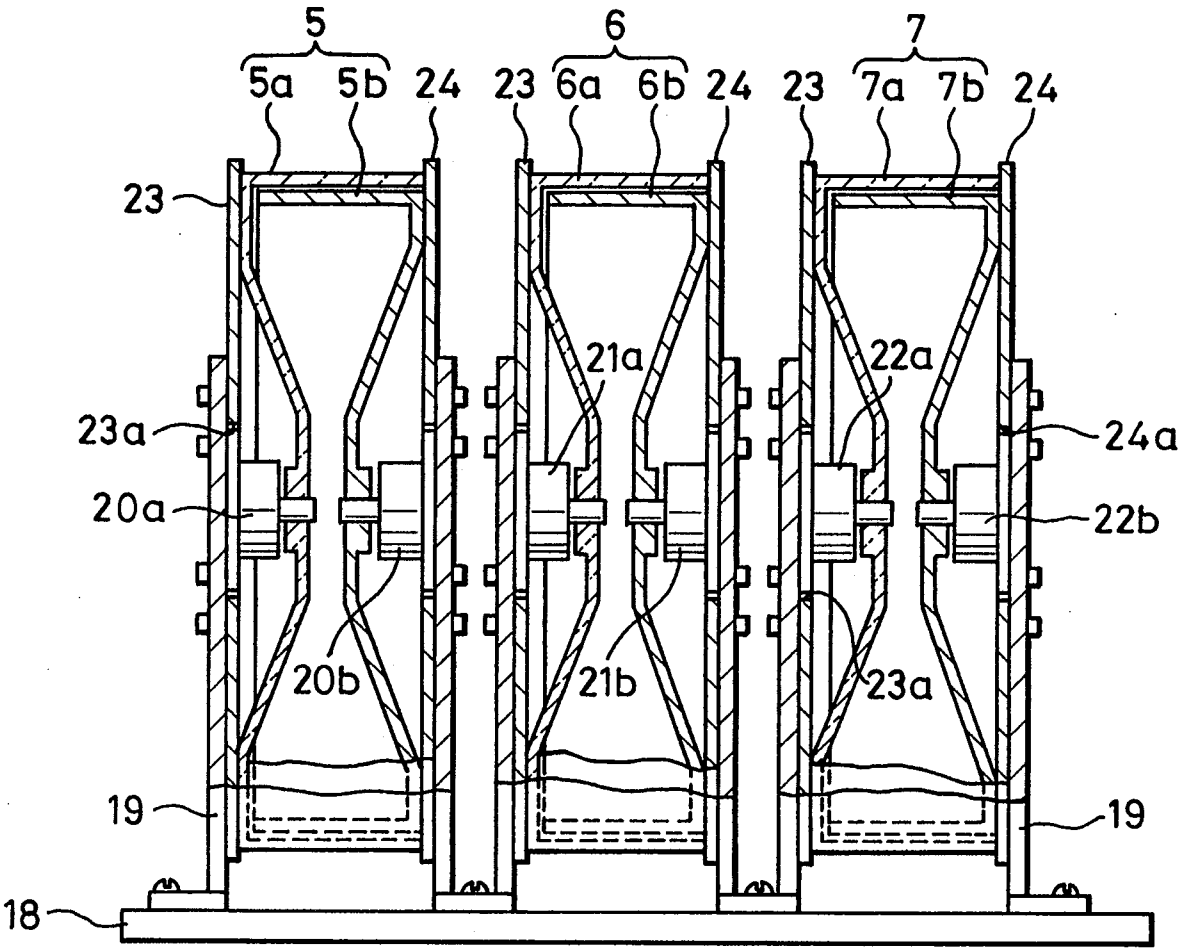
FIG. 3 is a cross section showing the main parts of a reel assembly.

FIG. 3 shows a reel assembly of the first to third reels 5 to 7. Reel retaining brackets 19 are fixed to a base plate 18. Fixed to the brackets 19 by means of, for example, hexagonal bolts, are two stepping motors 20*a* and 20*b*, 21*a* and 21*b*, 22*a* and 22*b* for each reel and rotation support plates 23 and 24 formed with central openings 23*a* and 24*a* for each reel.

The shafts of the stepping motors 20*a*, 21*a* and 22*a* are fixed to the outer reels 5*a*, 6*a* and 7*a* of the first to third reels, and the shafts of the stepping motors 20*b*, 21*b* and 22*b* are fixed to the inner reels 5*b*, 6*b* and 7*b* of the first to third reels. Each of the outer reels 5*a* to 7*a* rotates while sliding on the inner surface of the rotation support plate 23, and each of the inner reels 5*b* to 7*b* rotates while sliding on the inner surface of the rotation plate 24.

Figure 4:
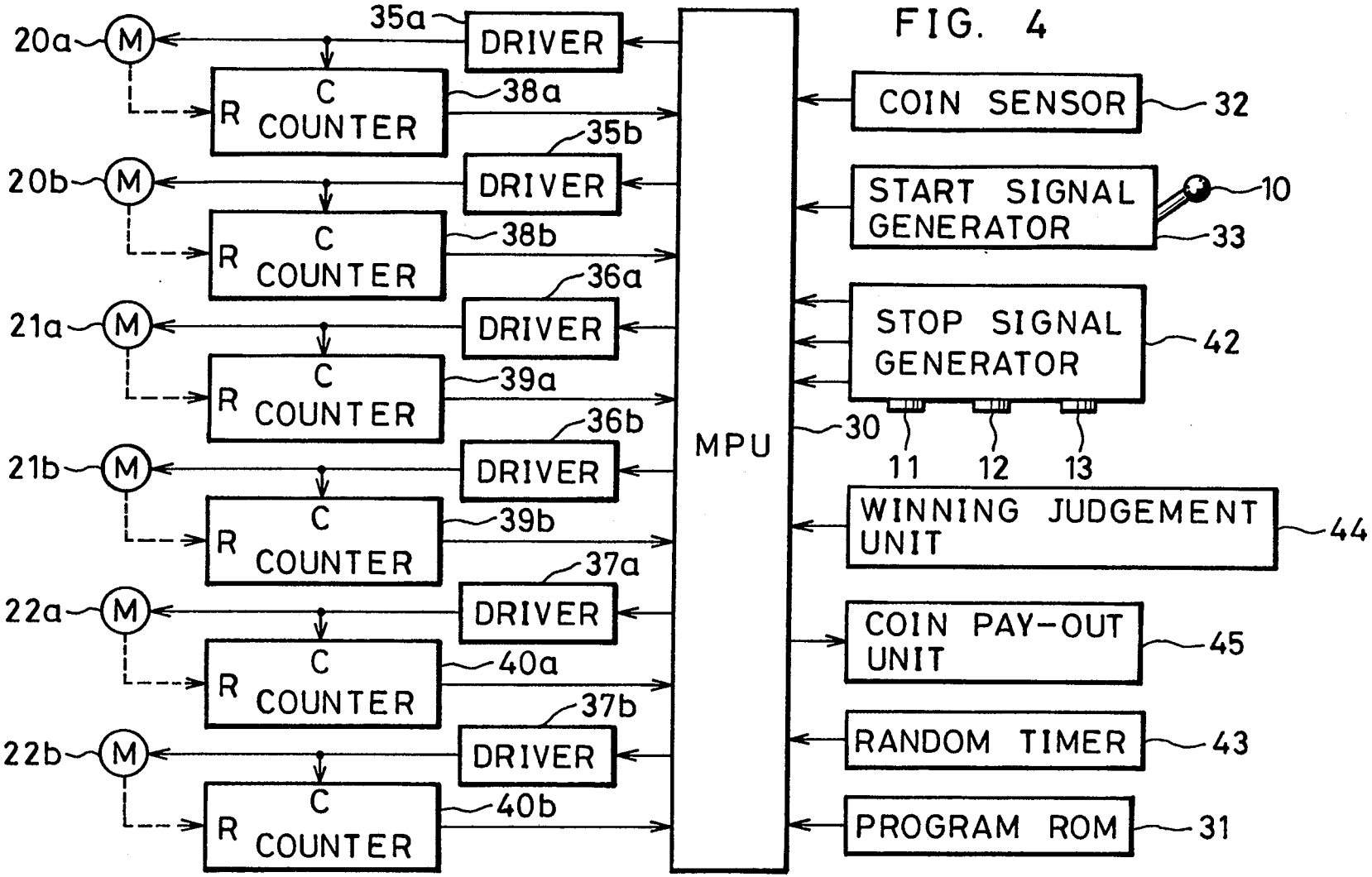
FIG. 4 is a functional block diagram showing an arrangement of electronic components of the slot machine of the invention.

The arrangement of electronic components of the slot machine of the illustrated embodiment is shown in FIG. 4. In FIG. 4, a microprocessor unit (MPU) 30 controls each game in accordance with a sequence program stored in a program ROM 31. A coin sensor 32 detects the number of coins entered into the coin inlet 9 and supplies the number to MPU 30 to determine the number of effective winning lines 8. When a start signal generator 33 detects an operation of the start lever 10, it supplies a start signal to MPU 30 which in turn rotates the first to third reels 5 to 7.

The first to third reels 5 to 7 start rotating when MPU 30 supplies clock pulses to drivers 35*a*, 35*b*, 36*a*, 36*b*, 37*a* and 37*b*. As each of the drivers 35*a* to 37*b* receives clock pulses from CPU 30, it supplies drive pulses corresponding to the frequency of clock pulses to each of the stepping motors 20*a* to 22*b*. Each stepping motors 20*a* to 22*b* rotates by a predetermined angle each time a drive pulse is supplied. Therefore, by counting the number of drive pulses, the angle of rotation of each stepping motor can be known. Drive pulses outputted from each driver 25*a* to 37*b* are counted by a corresponding one of the counters 38*a* to 40*b*. The stepping motors 20*a* to 22*a* are used for rotating the outer reels 5*a* to 7*a*, and the stepping motors 20*b* to 22*b* are used for rotating the inner reels 5*b* to 7*b*. The rotation direction of the stepping motors 20*b* to 22*b* is opposite to the rotation direction of the stepping motors 20*a* to 22*a*.

Reset pulses are applied to reset terminals of the counters 38*a* to 40*b* each time the stepping motors 20*a* to 22*b* pass by the rotation origin, and the counters are cleared to "0". As a result, the counts of the counters 38*a* to 40*b* correspond to the rotary angles during one rotation of the stepping motors. Since the order of disposing symbols on the outer circumferential frame of each reel 5*a* to 7*b* is known, symbols on the wining line 8 can be identified based on the counts of the counters 38*a* to 40*b*.

A stop signal generator 42 supplies an outer reel stop signal to MPU 30 when one of the stop buttons 11 to 13 is depressed. Upon reception of the outer reel stop signal, MPU 30 stops the rotation of the corresponding one of the outer reels 5*a* to 7*a*. For example, when the stop button 11 is depressed while the first reel 5 rotates, a supply of clock pulses to the driver 35*a* and a supply of drive pulses to the stepping motor 20*a* are intercepted, thereby to stop the rotation of the outer reel 5*a*.

A random timer 43 starts operating after the rotation of the outer reels 5*a* to 7*a* is stopped in response to the outer reel stop signals. The random timer 43 generates three inner reel stop signals at random timings and supplies them to MPU 30 which in turn stops the rotation of the inner reels 5*b* to 7*b* as in the stopping of the outer reels.

After the rotation of the first to third reels 5 to 7 has been stopped, a winning judgment unit 44 judges whether a symbol combination of an effective winning line is a win or not. The types of the symbols on the effective winning line can be identified from the counts of the counters 38*a* to 40*b* as described previously. If the winning judgment indicates a win, a coin pay-out unit 45 operates in response to an instruction from MPU 30 and pays out dividend coins corresponding in number to the win rank.

Figure 5:
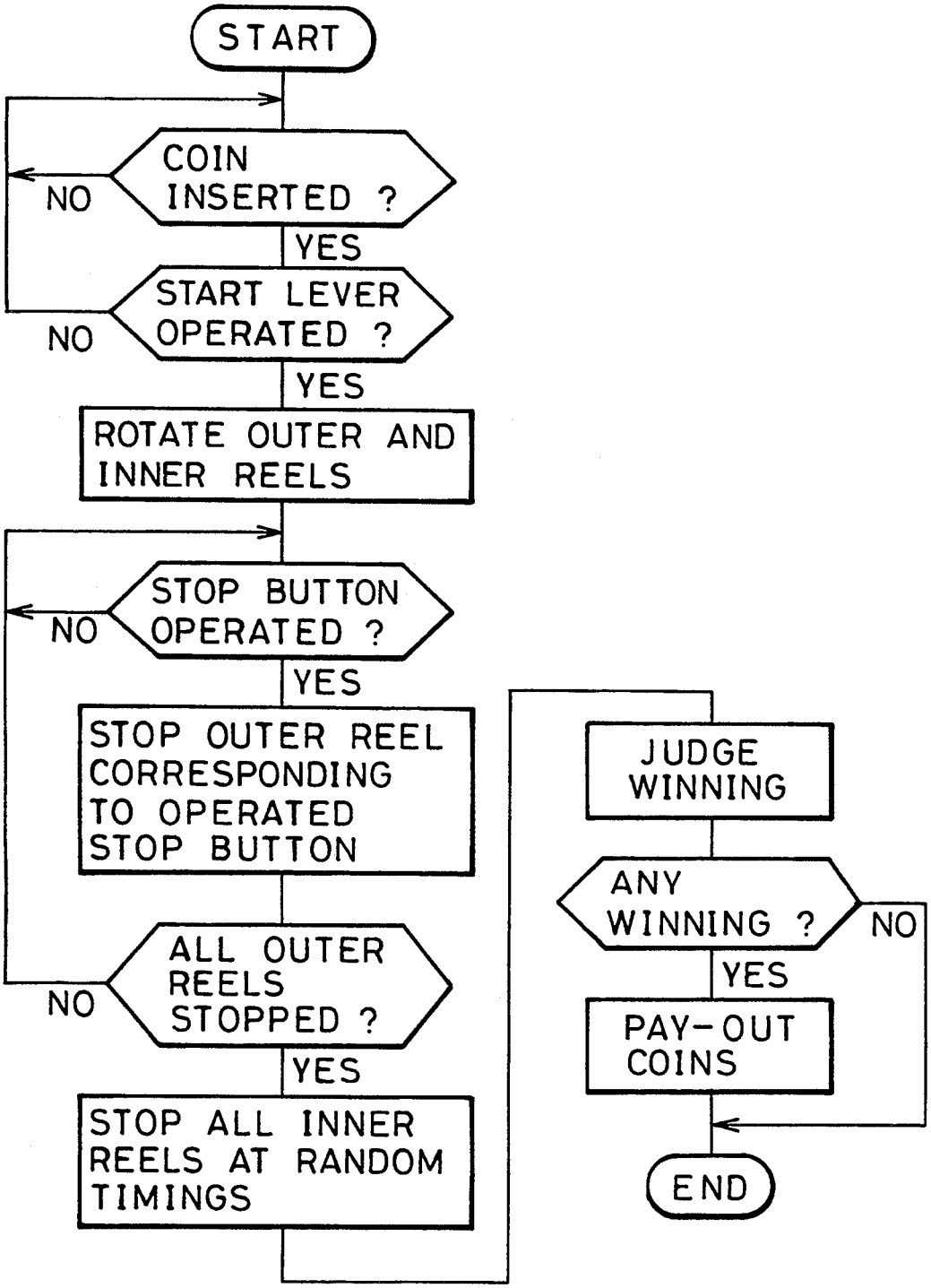
FIG. 5 is a flow chart explaining the game sequence.

The operation of the above embodiment will be described with reference to the flow chart of FIG. 5. If one coin is inserted from the coin inlet 9, the center winning line 8 No. 1 is made effective and lamps on opposite ends of this line are turned on. If two coins are inserted, two winning lines 8, namely No. 1 and No. 2 are made effective and lamps on opposite ends of these lines are turned on. If three coins are inserted, all three winning lines 8 are made effective.

When the start lever 10 is operated after inserting three coins, for example, MPU 30 supplies clock pulses to all the drivers 35*a* to 37*b* which supply drive pulses to the stepping motors 20*a* to 22*b*. These stepping motors 20*a* to 22*b* start at the same time to rotate all the first to third reels 5 to 7. Of the first to third reels 5 to 7, the outer reels 5*a* to 7*a* rotate in the counterclockwise direction as viewed in FIG. 2, and the inner reels 5*b* to 7*b* rotate in the clockwise direction. The symbols on the outer reels 5*a* to 7*a* which move downward can be observed, and those on the inner reels 5*b* to 7*b* which move upward can be observed through the transparent outer reels 5*a* to 7*a*. Two series of symbol trains moving in opposite directions can be observed via the observation windows 2 to 4, providing a fresh impression to a game player. Even if two series of symbol trains are moved in the same direction, a similar fresh impression can be given to a player by changing the rotation speed of each of the two series of symbol trains so that they do not move in unison.

As the stop buttons 11 to 13 are depressed at desired timings, the outer reels 5*a* to 7*a* are stopped in response to the outer reel stop signals from the stop signal generator 32. Let is be supposed that symbols on the outer reels 5*a* to 7*a* stop on winning lines.

Such symbol combinations on winning lines can be determined as in the case of a conventional slot machine, and the game is over. However, in the embodiment slot machine, even at this time the stepping motors 20*b* to 22*b* continue to be driven. Therefore, the inner reels 5*b* to 7*b* are still rotating, and moving symbols can be observed through transparent outer circumferential frames of the outer reels 5*a* to 7*a*.

Figure 6:
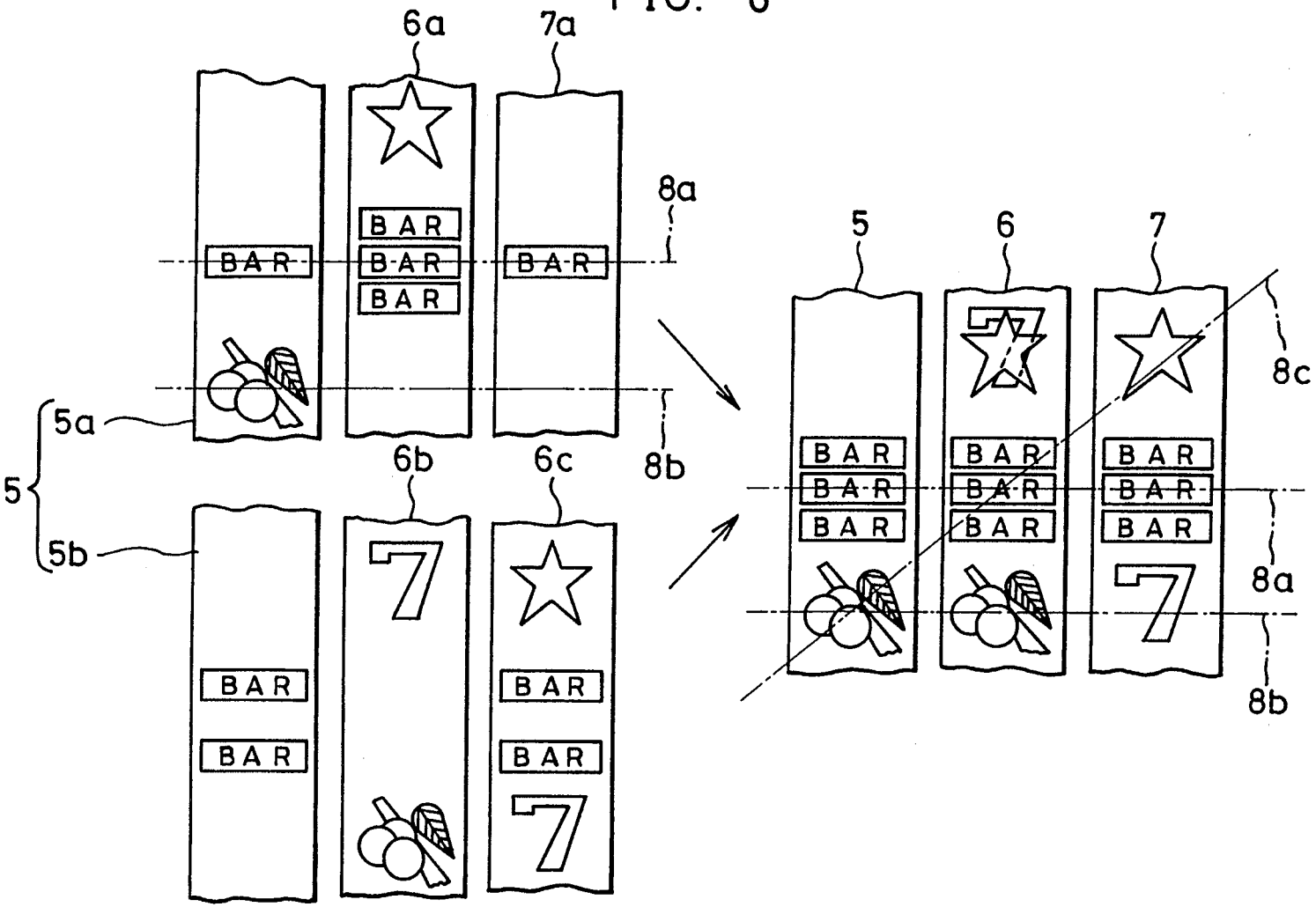
FIG. 6 shows an example of displayed symbols.

After all the outer reels 5*a* to 7*a* have stopped, the random timer 43 starts operating, and three inner reel stop signals are sequentially supplied to MPU 30. As a result, the three inner reels 5*b* to 7*b* are sequentially stopped. At this time, as shown in FIG. 6, the symbols on the outer reels 5*a* to 7*a* superposed upon the symbols of the inner reels 5*b* to 7*b* are viewed through the observation windows 2 to 4. Of the symbols on only the outer reels 5*a* to 7*a*, a winning symbol combination of "Cherry" "-" "-" is obtained on the winning line 8*b*. However, from the symbols of both the outer and the inner reels 5*a* to 7*a* and 5*b* to 7*b*, winning symbol combinations are formed on three winning lines 8*a*, 8*b* and 8*c*. On the winning line 8*a* in particular, although the symbol combination of only the outer reels 5*a* to 7*a* is "1 BAR" "3BAR" "1 BAR", which is a miss, the symbol combination of both the outer and the inner reels 5*a* to 7*a* and 5*b* to 7*b* is "3BAR" "3BAR" "3BAR" which is a high rank hit.

The inner reels 5*b* to 7*b* are stopped by use of the random timer 43. They may be stopped by generating inner reel stop signals in response to the depression of the stop buttons 11 to 13 after the outer reels 5*a* to 7*a* have stopped. The stop buttons 11 to 13 rnay be omitted and the outer reels 5*a* to 7*a* stopped in response to stop signals from the random timer 43, thereby to provide a self-stopping slot machine.

Thereafter, MPU 30 identifies the types of symbols on the winning lines 8 by referring to the counts of the counters 38*a* to 40*b*. In accordance with the symbol combination data, the winning judgment unit 44 judges whether there is a win. The coin pay-out unit 35 pays out dividend coins corresponding in number to the wins on the winning lines 8*a*, 8*b* and 8*c*, to thereafter terminate one game.

Since the reels 5 to 7 are of composite structure, having the outer and inner reels 5*a* to 7*a* and 5*b* to 7*b*, the number of symbols that can be displayed by the slot machine can be increased. Namely, a symbol on the inner reel appears in the observation window via the blank symbol on the outer reel, and another symbol is formed by a combination of two symbols on the inner and outer reels. For example, if three combined symbols of the "star" and "7", shown in the upper area of the outer circumferential frame of the second reel 6 in FIG. 6, are on a winning line, a jack pot is allotted to thereby give a unique interest in game which a conventional slot machine cannot provide.

Symbols may be formed only on certain ones of the outer reels a to 7*a* and inner reels 5*b* to 7*b*, and background colors in place of symbols can be displayed on the other reels. In this case, various winning ranks are determined by combinations of background colors on winning lines, by combinations of symbols on winning lines, and by combinations of symbols and background colors on winning lines.

Figure 7:
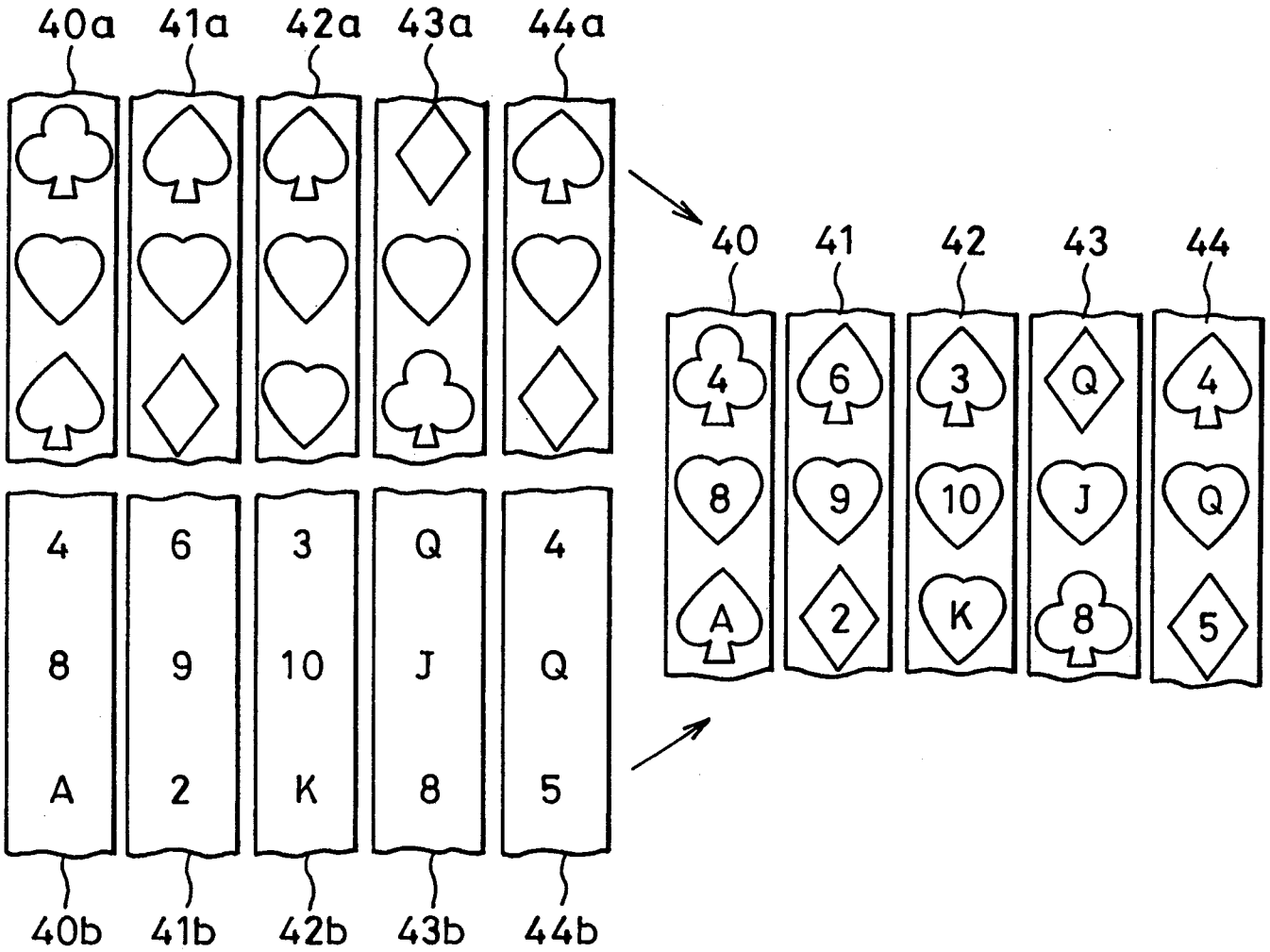
FIG. 7 shows another example of displayed symbols.

FIG. 7 shows examples of symbols used by a slot machine for playing poker. Similar to the first embodiment, first to fifth reels include outer reels and inner reels. Symbols of "heart", "club", "diamond" and "spade" suits are formed on the outer circumferential frames of the outer reels, and alphanumeric symbols including "A" to "10" and "J" to "K" are formed for the inner reels. Various combinations of symbols of the reels are produced from the symbols on the outer reels.

In a conventional slot machine of the driven reel type for playing a poker game, the number of trump cards per reel is limited by the outer diameter of the reel, the reel being unable to use the whole set of cards. In this embodiment, the whole set of trump cards can be prepared, allowing a player to have a simulation of a real poker game.

In the above embodiment, one of the first to third reels may be of a two-stage structure having an outer reel and an inner reel, and the remaining two reels may be conventional reels. The inner reels may be first stopped, and then the outer reels stopped. The winning judgment and dividend coin pay-out may be effected when the outer reels stop, or they may be effected later when the inner reels thereafter stop.

Although the present invention has been described with reference to the preferred embodiments shown in the drawings, the invention should not be limited by the embodiments but, on the contrary, various modifications, changes, combinations and the like of the present invention can be effected without departing from the spirit and scope of the appended claims.

What is claimed is:

1. A slot machine having a plurality of rotatable reels comprising an outer reel and an inner reel disposed coaxially within said outer reel;

said outer reel having a transparent outer circumferential frame, a plurality of symbols being disposed on said transparent outer circumference frame;

said inner reel having a plurality of symbols formed at an equal pitch on an outer circumferential frame of said inner reel; and means to rotate said reels simultaneously in opposite directions.

2. A slot machine having a plurality of rotatable reels comprising an outer reel and an inner reel disposed coaxially within said outer reel;

said outer reel having a transparent outer circumferential frame, a plurality of symbols being disposed on said transparent outer circumference frame;

said inner reel having a plurality of symbols formed at an equal pitch on an outer circumferential frame of said inner reel;

wherein said symbols of one of said outer and inner reels include "spade", "heart", "diamond" and "club"0 symbols, and said symbols of the other of said outer and inner reels include alphanumeric symbols "A" to "10" and "J", "Q" and "K".

3. A slot machine having a plurality of rotatable reels comprising an outer reel and an inner reel disposed coaxially within said outer reel;

said outer reel having a transparent outer circumferential frame, a plurality of symbols being disposed on said transparent outer circumference frame;

said inner reel having a plurality of symbols formed at an equal pitch on an outer circumferential frame of said inner reel;

wherein said symbols of said outer and inner reels are equally peripherally spaced apart about said reels, a said symbol on one of said outer and inner reels comprising two identical spaced markings and a said symbol on the other of said outer and inner reels comprising an identical marking which, when said reels are stopped in one position, it is disposed between said two spaced markings in the line of sight of a user of said machine.

* * * * *